US006223411B1

(12) United States Patent
Willey

(10) Patent No.: US 6,223,411 B1
(45) Date of Patent: May 1, 2001

(54) RESILIENT RETAINER FOR ELONGATED ITEMS AND METHOD OF HOLDING

(76) Inventor: Kevin E. Willey, 2630 Willow Creek Dr., Ft. Collins, CO (US) 80525

( * ) Notice: Subject to any disclaimer, the term of this patent is extended or adjusted under 35 U.S.C. 154(b) by 0 days.

(21) Appl. No.: 09/345,935

(22) Filed: Jul. 1, 1999

Related U.S. Application Data

(62) Division of application No. 09/028,028, filed on Feb. 24, 1998.

(51) Int. Cl.[7] ..... B23P 11/02; B21D 39/03
(52) U.S. Cl. ..... 29/450; 29/428
(58) Field of Search ..... 220/735, 710, 220/23.83, 23.86, 23.4, 669, 671, 694, 759, 758; 29/450, 428

(56) References Cited

U.S. PATENT DOCUMENTS

| | | | | |
|---|---|---|---|---|
| 390,089 | | 9/1888 | McClelland . | |
| 700,653 | | 5/1902 | Jobson . | |
| 1,903,410 | * | 4/1933 | Cecil | 220/735 |
| 2,738,101 | * | 3/1956 | Vander Ven | 220/735 |
| 2,738,114 | | 3/1956 | Kahlan et al. | 220/758 |
| 2,864,510 | * | 12/1958 | Sture | 211/70.3 |
| 3,688,935 | | 9/1972 | Owen et al. | 220/735 |
| 3,823,814 | * | 7/1974 | Lum | 206/225 |
| 4,715,505 | | 12/1987 | DeMars | 215/100 R |
| 4,943,017 | * | 7/1990 | Ennis | 220/758 |
| 5,178,354 | | 1/1993 | Engvall | 248/316.7 |
| 5,544,783 | * | 8/1996 | Conigliaro | 220/735 |
| 5,558,247 | * | 9/1996 | Caso | 220/735 |

FOREIGN PATENT DOCUMENTS

| | | | |
|---|---|---|---|
| 932303 | 8/1973 | (CA) | 220/758 |

* cited by examiner

*Primary Examiner*—Icuda Rosenbaum
*Assistant Examiner*—Marc Jimenez
(74) *Attorney, Agent, or Firm*—Macheledt Bales & Johnson LLP

(57) ABSTRACT

A retainer for removably holding an elongated item to a larger member including the following features: a closed-loop band having elasticity for arrangement around a periphery of the larger member; and a loop for retaining the elongated item, wherein first and second ends of this loop protrude from a wall of the band. Also, a retainer including the band and a looped portion (integrated with the band) that has a taper angled to guide an end of the elongated item into the loop to be retained thereby. The band may have an outwardly-facing grip surface against which the elongated item can lean. The loop/looped portion, whether it has a taper, can have gripping teeth or suitable textured surface. A system comprising a retainer with its band arranged around the periphery of a larger member. A method of removably holding an elongated item to an outside wall of a larger member including: arranging a closed-loop resilient band around a periphery of the larger member, the band having first and second ends of a loop protruding from a wall of the band; and guiding an end of the elongated item into and through the loop along a taper. Or, arranging a band having a looped portion protruding from a wall thereof; and guiding an end of the elongated item into and through the looped portion so that once retained therein, a top-end of the item is oriented out and away a distance from the larger member.

7 Claims, 7 Drawing Sheets

RESILIENT RETAINER FOR ELONGATED ITEMS AND METHOD OF HOLDING

This is a division of application Ser. No. 09/028,028, filed on Feb. 24, 1998.

BACKGROUND OF THE INVENTION

In general, the present invention relates to a novel retainer, retaining system, and method of removably holding elongated items of many different cross-sections, widths and lengths to an outer wall of a larger member; and more particularly, to a new retainer having elasticity and method of removably holding an elongated member such as a straw, drink stirrer, tweezers, micro-tool (such as for repairing a watch, pair of glasses, or an electronic gadget), pencil, drill bit, an electric cord, knitting needles, and so on, to a larger receptacle or instrument member (such as a spray can, coffee canister, glass/mug, holder for pencils or other items, note pad, sewing or knitting basket, medical container or instrument, and so on). The new retainer, retaining system, and method comprise a band for arrangement around a periphery of the larger member, and a loop (or looped portion) for retaining the elongated item therein when not in use.

Plastic tubular-shaped straws are often connected to the outlets of aerosol spray cans containing lubricants, expandable foam, drywall patch and other materials used in construction of buildings, and de-greasing agents, to direct the flow of the aerosol when dispensed from the can. Dispensing straws and other tubular-shaped or solid elongated items are not only sold for use with aerosol spray containers, but also with bottled and otherwise packaged drinks, foods, novelties, and so on. Since it is important that the straw or other elongated item be readily available for use as needed, it is typically taped, glued (using a strong solvent-resistant adhesive or food-grade paraffin-based adhesive), or held to the outside of the container, bottle, or packaging with an elastic rubber band. Consumers who use pressurized spray cans (or other products contained in a receptacle) that are sold with a straw often lose the straw soon after it is removed from the side of the container since there is no reliable way to reattach the straw to the container: Once the seal of a bead of solvent-resistant or paraffin-based adhesive is broken, it is not reusable; removing and reapplying the piece of tape a few times removes its sticky surface; and, if not lost soon after removing the straw, a rubber band typically breaks. In addition, each of these known means of holding a straw or other elongated item to a receptacle member orients the straw or other elongated item vertically parallel to, or forced against, the outside wall of the receptacle making straws and other items with small diameters very difficult to grasp and remove from the side of the receptacle.

Others have proposed various designs to hold items against the side of a container and have disclosed their designs in U.S. Patents: The clip-on device with a circular aperture 22 and a pair of gripping means 40 for assisting in manual biasing of distal ends 34 disclosed in U.S. Pat. No. 5,558,247 issued to Caso; The flexible spring like clip-on device having jaws 30, 32 to secure the straw 26 as disclosed in U.S. Pat. No. 5,544,783 issued to Conigliaro; The pipe-holding rim 3 having integrally attached members 4 that depend downwardly from rim 3 (members 4 are lifted up so that a pipe stem can be fed from the bottom through opening 5) disclosed in U.S. Pat. No. 2,738,101 issued to VanderVen; The smoker's pipe rack having apertures 15 formed in a flange 12 outwardly extending from (and integral to) a circular collar 11 disclosed in U.S. Pat. No. 2,864,510; A cover for a tumbler having openings D defined by gripping-jaws $C^2$ disclosed in U.S. Pat. No. 700,653 issued to Jobson; The loose encircling band B provided with a clip R for holding a tooth-brush disclosed in U.S. Pat. No. 390,089; A tube holder adapted for attachment to the surface of an aerosol can having a pair of resilient, tube grasping members for receiving the tube therebetween disclosed in U.S. Pat. No. 5,178,354; and The bracket member 14 of a C-shaped configuration having jaws 16, 18 and recess 20 to receive a swizzle stick attached to a novelty-glass disclosed in U.S. Pat. No. 4,715,505.

None of the inventions disclosed in these U.S. Patents offer a simple, yet effective, flexible design that can be readily manufactured. The applicant has been unable to find any of these designs in general distribution for use to removably hold an elongated item to a container. One reason for this is that the solutions proposed in these patents are not practical, cost-effective solutions. Without reasonable alternative solutions at hand for holding, removing and reattaching for later reuse, dispensing-aid straws and other useful items to their respective container members, consumers will continue to misplace, and/or dispose of, these useful items. One can see that the novel retainer of the invention, and associated method of removably holding an elongated item to an outside wall of a larger member, as described herein, provide support and stability to a straw or other elongated item without requiring any redesign of aerosol cans or other containers currently in use.

This simple innovative retainer and its associated method as described herein, are designed for operative arrangement around the periphery of a wide variety of larger receptacles or instrument members currently in use (such as a spray can, coffee canister, glass/mug, any holder for pencils or other hand-held items, note pad, sewing or knitting basket, medical container or instrument, and so on), as well as container designs under development. The retainer and associated method of the invention, as designed allow for relatively easy arrangement around, and removal from, a larger member—and such arrangement and removal can be done without special tools. Furthermore, unlike the designs currently in use and unlike those designs disclosed in the U.S. patents listed above, the innovative retainer of the invention operatively arranged around a larger member, accepts and removably holds an elongated item so that the item will lean against an outwardly-facing surface of the retainer to orient a top-end of the item out and away a distance from the outside wall of the larger member. This makes the elongated item as held, easier to grasp and remove from the retainer.

As will be appreciated, in the spirit of these design goals, the innovative retainer, retaining system, and associated method described herein: can be operatively arranged around the periphery of a larger member using many different methods; can have one or several loops/looped portions each of which is capable of retaining an elongated item—these loops can be initially oriented inward, outward, upward, or downward with respect to a central area of a band of the retainer; these loops/looped portions can take on many different shapes depending upon the cross-sectional shape of the elongated item being held; and the retainer can be made from many different types of materials as a unitary piece, or as an assembly mechanically fastened together (by way of a tongue-and-groove or other matingly-shaped joint, thermal bonding, or secured together with a suitable adhesive).

SUMMARY OF THE INVENTION

It is a primary object of this invention to provide a retainer for removably holding an elongated item to a larger member that has a closed-loop band for arrangement around a periphery of the larger member, and a loop for retaining the elongated item that has first and second ends protruding from a wall of the band; or to provide such a retainer that has a closed-loop band and a looped portion having a taper angled to guide an end of the elongated item so that the item can be retained thereby. It is also an object of this invention that, upon arrangement of the band around the periphery and insertion of the item into and through the loop/looped portion, a top-end of the elongated item is oriented out and away a distance from the outside wall of the larger member. Additional objects include: providing a novel system that includes a retainer of the invention; and providing a method of removably holding an elongated item to an outside wall of a larger member.

The advantages of providing the new retainer, the new retaining system, and the new method of removably holding an elongated item to an outside wall of a larger member, as described herein, are as follows: (a) The retainer as designed holds a dispensing straw or other elongated item to its respective receptacle or instrument member during shipment, and otherwise holds the elongated item while not in use, yet allows for single-handed manual removal of the item; (b) No redesign of known larger receptacles or instrument members currently in use, or being developed, is necessary to use the retainer; (c) The retainer can be arranged around, and removed from, a larger receptacle or instrument member with relative ease and without special tools; (d) Once the novel simple, yet effective, retainer is arranged around a periphery of a larger member, or the method of removably holding an elongated item to an outside wall of a larger member is employed, an elongated item inserted into the loop/looped portion can be oriented such that it is easier to grasp and remove; (e) Design simplicity—the novel retainer as designed with few components is inexpensive to fabricate using known materials and molding techniques; (f) Design flexibility and versatility—the novel retainer, retaining system, and method as designed can accommodate a wide range of types, sizes and shapes of larger members and the elongated items to be held therewith, and the novel retainer, system, and method can be used with receptacles containing a wide range of harsh chemicals without deteriorating; and (g) Little additional space is required to incorporate the novel retainer and method of the invention with larger receptacle and instrument members.

Briefly described, the invention includes a retainer for removably holding an elongated item to a larger member. The retainer can include the following features: a closed-loop band having elasticity for arrangement around a periphery of the larger member; and a loop for retaining the elongated item, wherein first and second ends of this loop protrude from a wall of the band. The retainer can also be comprised of the closed-loop band and a looped portion (integrated with the band) that has a taper angled to guide an end of the elongated item into the loop so that the elongated item can be retained thereby. The closed-loop band may have an outwardly-facing grip surface against which the elongated item can lean. The wall from which the loop/looped portion protrudes can be facing inwardly, outwardly, downwardly, and so on. The closed-loop band could be arranged around the periphery by wrapping it around and employing a mechanical band catch, placing it over an upper or lower lid of an outside wall of the larger member and sliding, or otherwise positioning, the band in place. The loop/looped portion, with or without a taper, can have gripping teeth for gripping the elongated item upon insertion; and the grip surface can be textured in a variety of ways or could include alignment teeth.

Also characterized herein, is a system comprising a retainer with its closed-loop band arranged around the periphery of a larger member. This system can include the elongated item retained by the loop/looped portion, and can also include the elongated item leaning against an outwardly-facing grip surface.

The invention also includes a method of removably holding an elongated item to an outside wall of a larger member. The method can comprise the steps of: arranging a closed-loop resilient band around a periphery of the larger member, the band having first and second ends of a loop protruding from a wall of the band; and guiding an end of the elongated item into and through the loop along a taper. The method can also be comprised of the steps: arranging a closed-loop resilient band around a periphery of the larger member, the band having a looped portion protruding from a wall thereof; and guiding an end of the elongated item into and through the looped portion so that once retained therein, a top-end of the item is oriented out and away a distance from the larger member.

BRIEF DESCRIPTION OF THE DRAWINGS

The invention will be more particularly described by referencing the accompanying drawings of the preferred embodiments, in which like numerals designate like parts.

The side view in FIG. 8, as well as the top plan views labeled

Figure 10B:
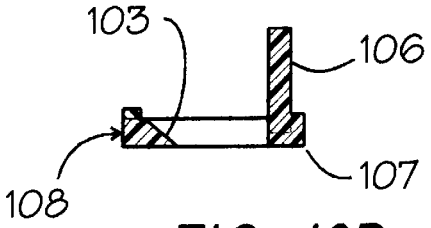
Figure 10A:
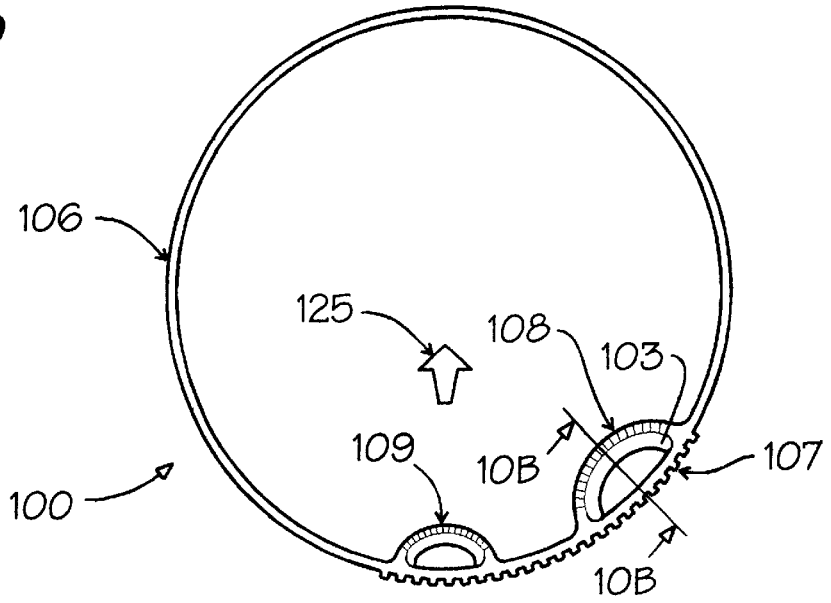

The sectional view labeled FIG. 10B was taken along 10B—10B of FIG. 10A to better illustrate the initial orientation of loop 108 with respect to band 106.

DETAILED DESCRIPTION OF THE PREFERRED EMBODIMENTS

Figure 1A:
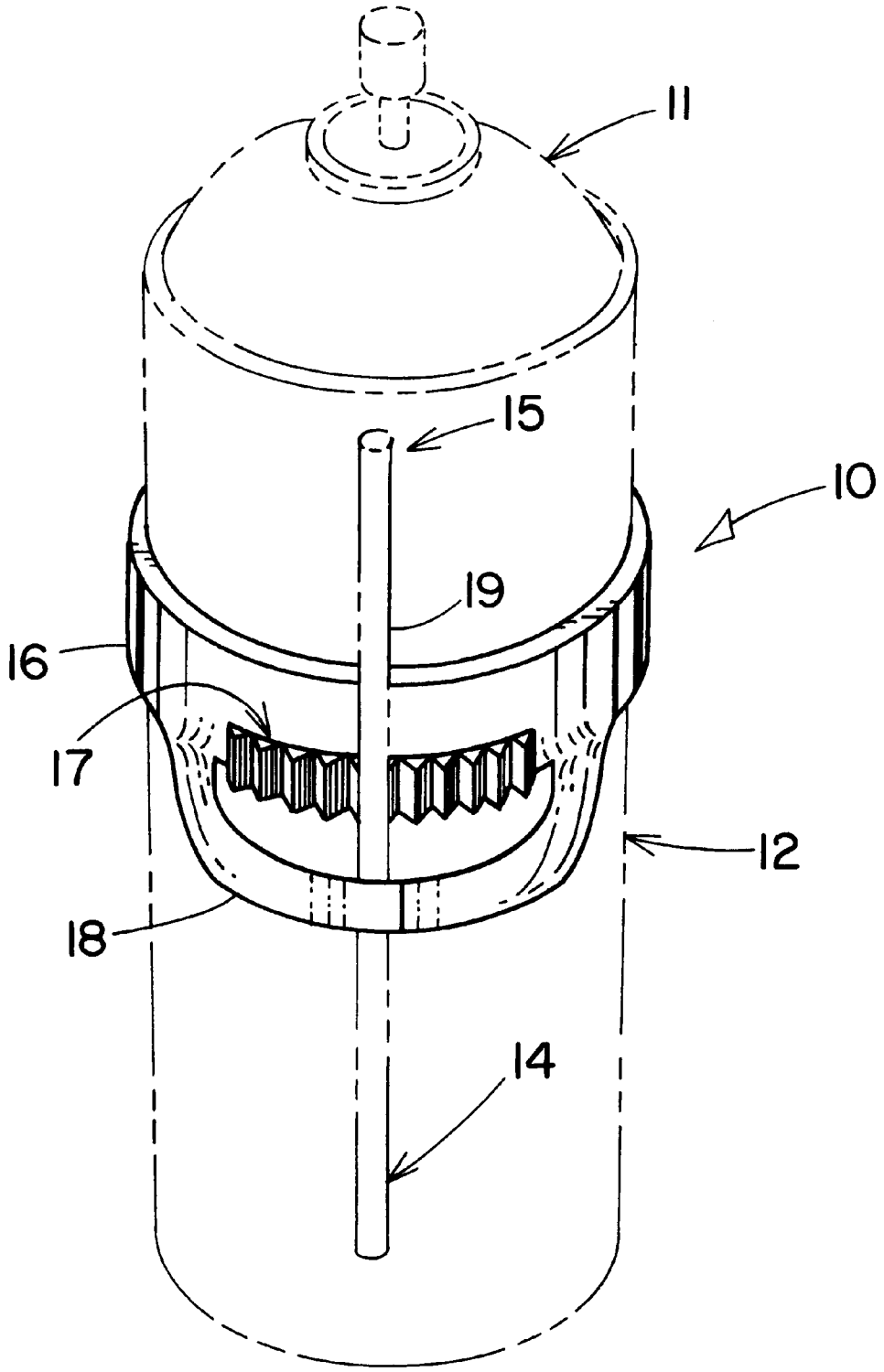
FIG. 1A is an isometric view of a preferred retainer 10 of the invention shown operatively arranged around the periphery 12 of larger canister member 11 (in phantom); an elongated item 19 (also shown in phantom) has been guided into and through loop 18.

Larger receptacle or instrument members such as the aerosol spray can 11 illustrated in phantom in FIG. 1A are currently often distributed with a dispensing straw, or other useful elongated item, temporarily attached to the outside of the larger member by way of tape, a bead of an adhesive substance, or a common elastic rubber band. The innovative preferred retainer 10 has been arranged around the periphery 12 of member 11. A loop (or looped portion) 18 integral to band 16, is shown holding item 19 (shown in phantom as a straw, by way of example only); the end 14 of straw 19 having first been guided into and through the loop 18. As can be better appreciated in FIG. 1B, top-end 15 of item 19 is oriented out and away from the outside wall of member 11. Band 16 has an outwardly-facing grip surface 17 illustrated here as a series of alignment teeth.

Figure 1B:
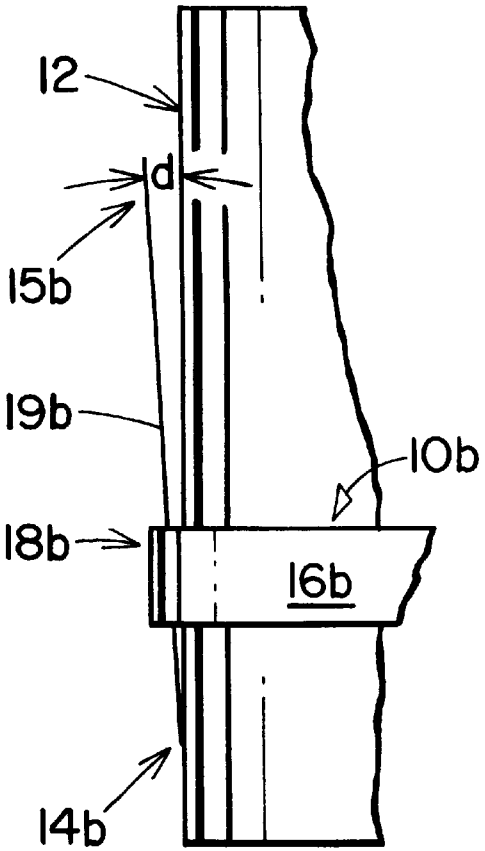
FIG. 1B is a partial side elevational view illustrating the general location of an elongated item 19*b* as held by looped portion 18*b* of preferred retainer 10*b*.

The elevation labeled FIG. 1B illustrates the general location of an elongated item 19*b* held by looped portion 18*b* protruding from or integrated with band 16*b* of preferred retainer 10*b*. End 14*b* of elongated item 19*b* has been guided into looped portion 18*b* for retaining. As explained in connection with other figures, looped portion 18*b* is preferably tapered or otherwise configured so that top-end 15*b* of item 19*b* is oriented a distance labeled "d" from periphery 12 to make elongated item 19*b* easier to grasp and remove.

Figure 2A:
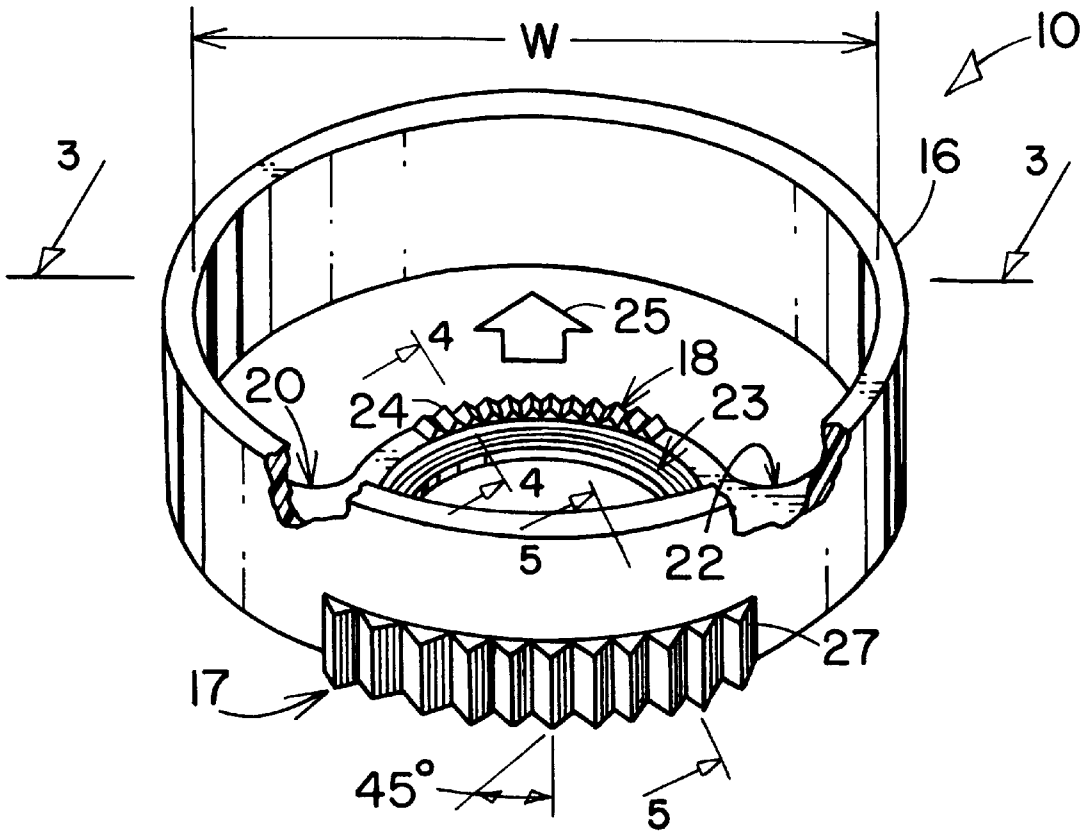
FIG. 2A is an isometric view of the preferred retainer 10 of the invention also illustrated in FIG. 1A; loop/looped portion 18 is initially oriented toward a central area of band 16 (see arrow 25 for reference).

Preferred retainer 10 in FIG. 2A illustrates many novel features of the invention. One can see how loop/looped portion ends 20, 22 protrude from band 16. Both of these ends 20, 22 have been thickened and a slight radius has been molded into each point of attachment to minimize wear, fracture and breakage. For purposes of illustration, portions of band 16 have been cut-away to reveal a radius molded into each end 20, 22. There are other suitable alternative reinforcement means to minimize wear and breakage at the points where ends 20, 22 protrude from band 16 such as embedding a thin shim or other similar known reinforcement within the walls of retainer 10 at the points of protrusion. Although shown as integral with band 16, looped portion 18 could instead be mechanically fastened together (by way of tongue-and-groove, recess-and-knob, key and keyhole, or other similar joint; thermal bonding; or secured together with a suitable adhesive). Although the type of fastening means is not critical, it must be able to adequately secure looped portion 18 to band 16 (especially if the band and loop are fabricated from different materials).

Figure 2B:
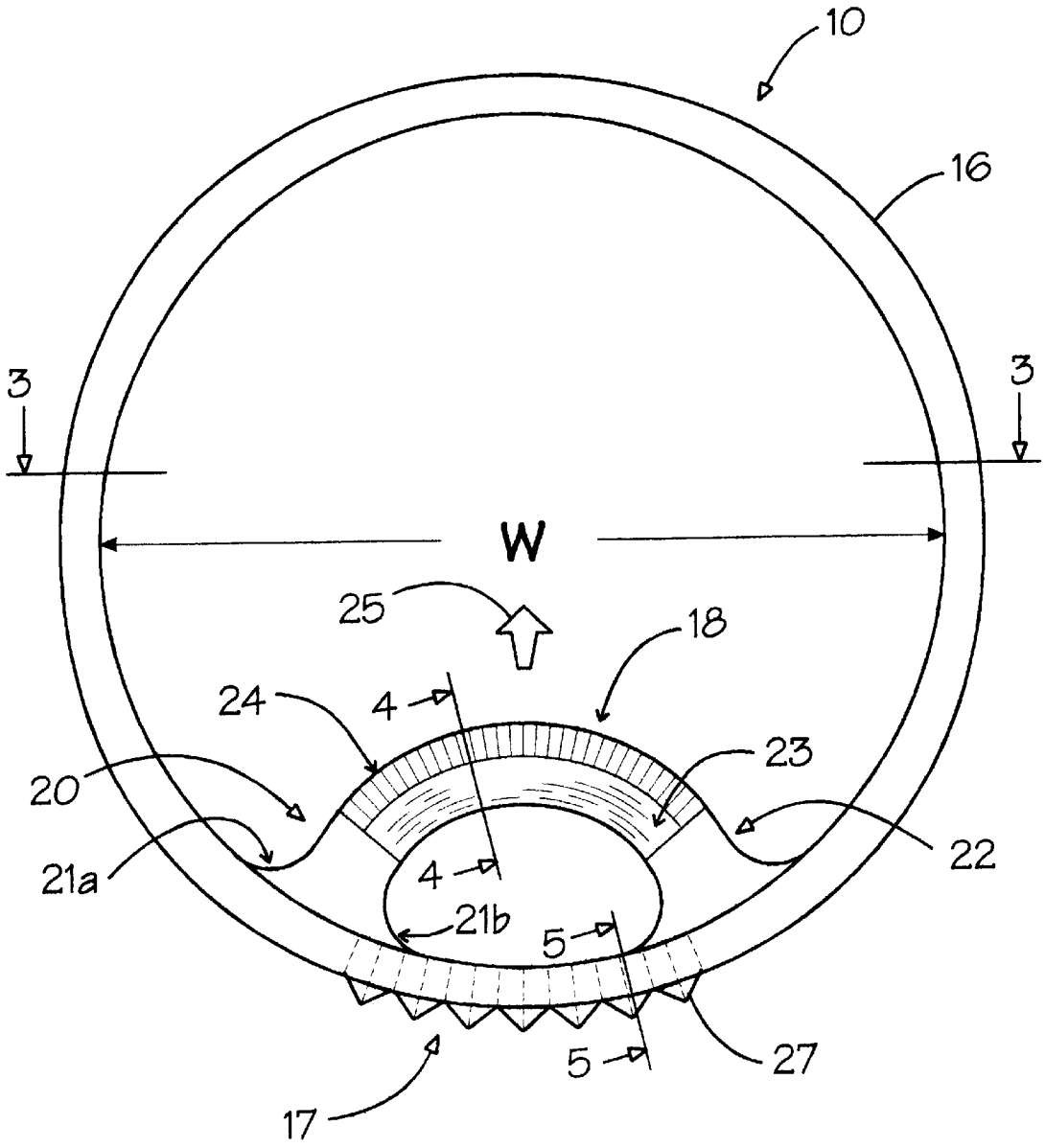
FIG. 2B is a top plan of preferred retainer 10 (FIG. 1A), having been modified slightly to include two radii for additional reinforcement at each end 20, 22 of loop 18.

FIG. 2B is a top plan view of the retainer 10 of FIG. 2A, except that taper 23 has been truncated nearby each end 20, 22 of loop/looped portion 18, and two radii (such as 21*a*, 21*b* labeled in connection with end 20) have been molded into each end 20, 22.

Throughout the Figures illustrating the invention, Band 16 is illustrated as circular in shape. The particular shape of band 16 is not critical. It is, however, critical that band 16 be shaped for arrangement around its respective larger receptacle or instrument member. As discussed above, many many different uses of the retainer, retaining system, and method of holding an elongated item to an outside wall of a larger member, as described herein are contemplated. The larger members, depending upon their use, may have a periphery that is square, rectangular, oblong, triangular, or otherwise irregular in shape. If band 16 is made out of a sufficiently resilient plastic so that it can stretch a great deal without permanently deforming, a circular band 16 could be arranged around an irregularly shaped container member.

Also, in several of the Figures illustrating the invention, looped portions 18 as well as 88, 98, 108 and 109 (in FIGS. 8, 9, and 10A respectively) are shown as D-shaped. The particular shape of looped portions 18, 88, 98, 108, 109 (as well as 18*b* in FIGS. 7A and 7B) is not critical. It is critical that the loop/looped portion of the retainer and method of the invention be shaped to adequately retain an elongated item it has been designed to hold to a larger receptacle or instrument member. As discussed above, many many different types of elongated items are contemplated. The flexibility of this novel design is that the loop/looped portion can be made into a D-loop as illustrated (although not limited as such) and be capable of holding items of various shapes and sizes. The looped portion need not be made of the same material as the band from which it protrudes. For example, although a highly resilient band may be desired, one may wish to fabricate the looped portion out of a stiffer, less resilient material.

Figure 4:
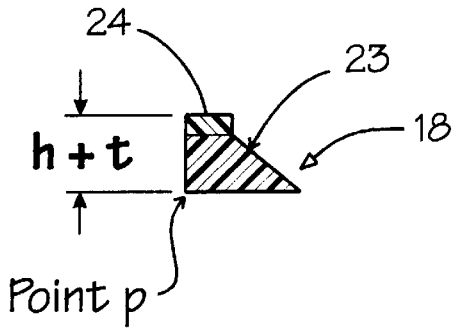
FIG. 4 is a sectional view of looped portion 18 taken along 4—4 of FIGS. 2A/B showing taper 23 and a gripping tooth 24.

Returning, now, to FIG. 2A, tapered section 23 of loop 18 is shown in proximity with several "zig-zag" shaped gripping teeth 24 (further detail in the sectional FIG. 4). Also, the outwardly-facing grip surface (labeled 17) is shown to include an upper section 27 of several "zig-zag" shaped alignment teeth (further details of both an upper section 27 and lower section 37 of teeth can be found in the sectional FIGS. 5 and 6). As can be better appreciated in the system drawing of FIG. 6, when preferred retainer 10 is arranged around periphery 12 of container member 11, an elongated item 19 positioned within loop 18 is gripped by gripping teeth 24 of loop 18. As can be better appreciated in the system drawing of FIG. 1A, the grip surface 17 located on an outer surface of band 16 can be included to help align item 19. In either case, gripping teeth 24 and the alignment teeth 27 can be replaced with a suitably textured surface, a series of teeth having a different configuration (for example, flat teeth), pins, beaded embossment, or other such protuberance for gripping and/or alignment of item 19 when being retained by loop 18.

The inner diameter "w" of band 16 (labeled in FIGS. 2A/B) can be made slightly smaller than or almost equal to the outer diameter of container 11. The band's inner diameter "w" will depend upon the specific properties of the material chosen for retainer 10. If band 16 is made out of a relatively resilient elastomer (preferably an elastomer or rubber which, when loaded or stretched in the manner contemplated by the invention, will not exceed its elastic limit and permanently deform), it will stretch with relative ease. A resilient elastomeric band 16 will be capable of being stretched prior to arrangement around periphery 12, and return to its unloaded shape around container 11—such a band can be fabricated with "w" smaller than the container's outer diameter. If retainer 10, or components thereof, are molded or extruded, using well known techniques, out of a thermoplastic elastomer (such as nylon which is less resilient, but very resistant to chemicals), band 16 will be made closer in size (if not slightly larger) to the container's outer diameter. If the material used to make retainer 10 has a tacky outer surface, then the inner wall of band 16 could be coated with, for example, a fluorocarbon (TFE, PTFE) to allow for ease of sliding retainer 10 along the outer wall of container 11. If receptacle 11 contains a harsh solvent or other chemical, it is critical that retainer 10 be made from a plastic material resistant to degradation by that solvent.

Most plastic materials exhibit elastic and plastic deformation to some degree (these are called elastic-plastic materials). As one increases the load applied to an elastic-plastic material shape, initially elastic deformation is observed (where upon removal of the force, the original shape is recovered). If a strong enough force is applied over a long enough time to a elastic-plastic material shape, a point will be reached at which permanent bending or deformation occurs and remains after release of the load (called plastic deformation). Upon the application and release of a force to stretch an elastic band 16 around the outer wall of a receptacle 11, its original shape will generally be recovered around the receptacle 11. Sustaining such a force for a long period of time (for example, if the band is left arranged around the receptacle for many days or months), will likely cause some permanent deformation of the retainer 10. This is of no serious consequence as it is easy to replace a severely permanently deformed or fractured retainer. Additional technical information regarding properties of suitable resilient plastic materials that are resistant to degradation by solvents or other chemicals, can be found in Professor Roy A. Lindberg's "*Processes and Materials of Manufacture*", 2nd edition, 1977 published by Allyn and Bacon, Inc. (in Boston, Mass.).

Figure 3:
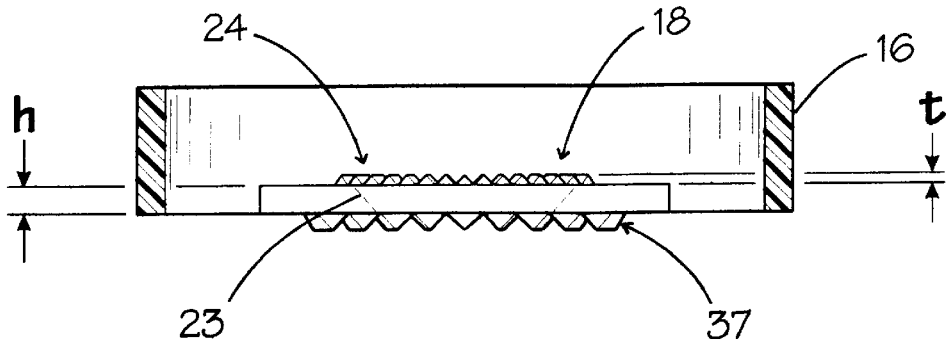
FIG. 3 is an inside sectional view of preferred retainer 10 taken along 3—3 of FIGS. 2A/B showing a side elevation of loop/looped portion 18.

FIG. 3 (taken along 3—3 of FIGS. 2A/B) is a sectional elevational view looking at the side of looped portion 18 (its height has been labeled "h" for reference) from the inside of band 16. The height of gripping teeth 24 has been labeled "t". Taper 23 is shown in phantom and angled approximately 45 degrees from vertical (for example). Although lower section 37 of alignment teeth (see also FIG. 5) is visible, upper section 27 (which is outwardly facing from band 16) is hidden from view.

Figure 5:
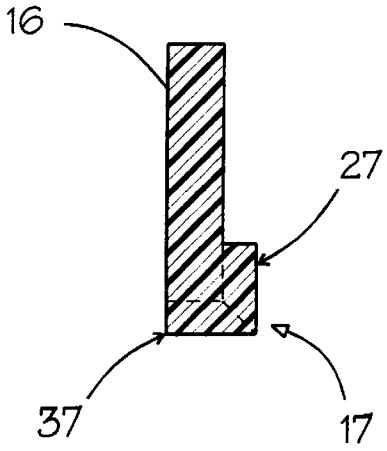
FIG. 5 is a sectional view of a preferred closed-loop band 16 taken along 5—5 of FIGS. 2A/B showing outwardly-facing grip surface 17 of band 16.

The sectionals in FIGS. 4 and 5 illustrate, respectively, preferred configurations of looped portion 18 and grip surface 17—these sections were taken from FIGS. 2A/B along 4—4 and 5—5, respectively. As mentioned above, one can readily appreciate that looped portion 18 and grip surface 17 can have many different equivalently-functional configurations (suitable texturing, a series of flat or otherwise configured teeth, pins, beaded embossment, or other such protuberance for gripping and/or alignment of item 19). A point "p" has been labeled for reference on FIG. 4 as well as FIG. 6.

Figure 6:
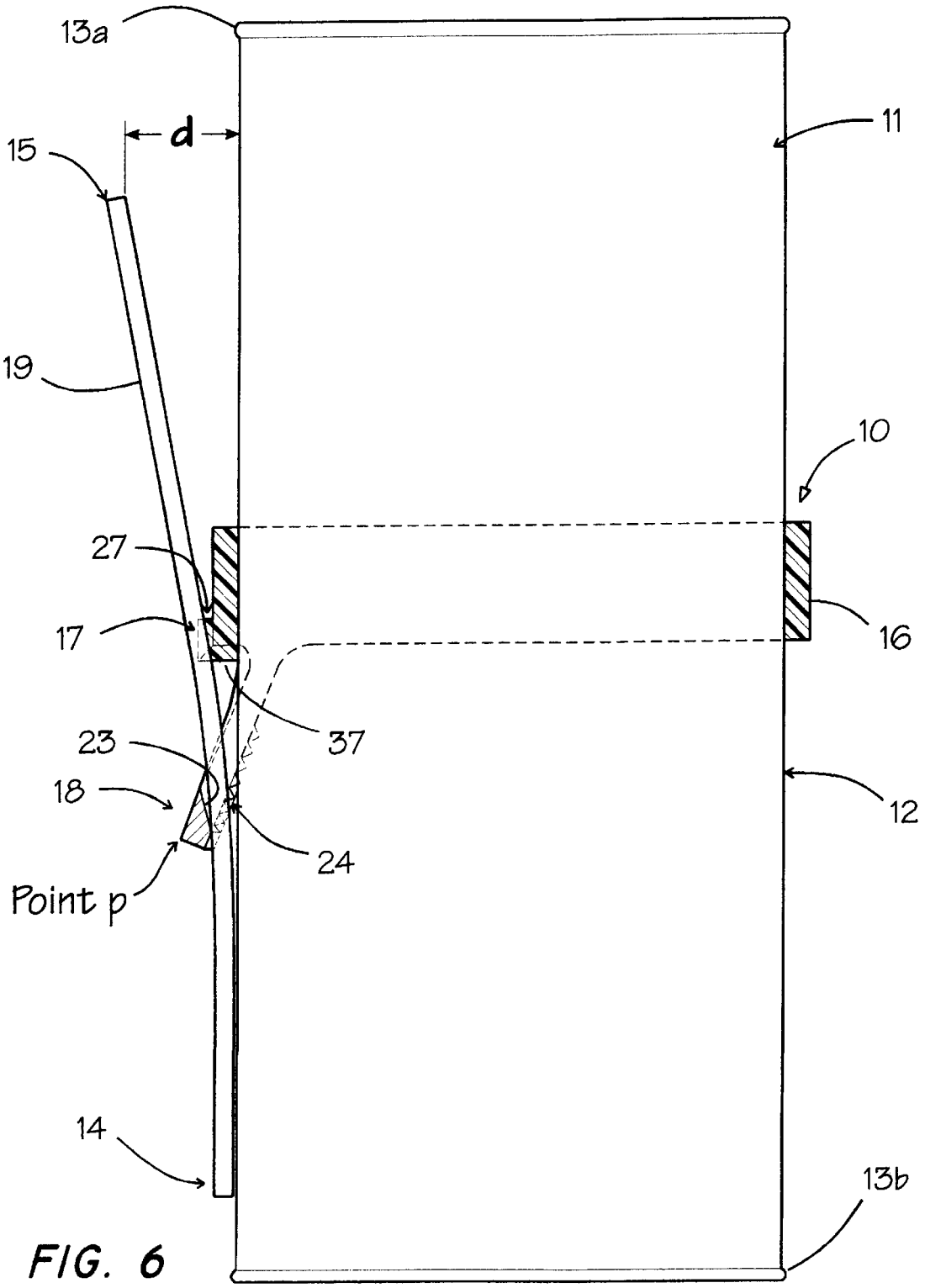
FIG. 6 is a sectional view from FIG. 1A of a preferred retainer 10 arranged around the periphery 12 of a larger member (represented by rectangle 11). An elongated item 19 has been inserted so that its top-end 15 is oriented distance "d" from member 11.

The FIG. 6 sectional of preferred retainer 10, taken at the point through item 19 in FIG. 1A, shows retainer 10 arranged around larger member (represented by rectangle 11). Preferably loop 18 is initially oriented toward a central area of band 16; and upon arranging retainer 10 around member 11, loop 18 is forced downward. A point "p" has been labeled for reference on loop 18 here, as well as in FIG. 4. If retainer 10 were flipped upside down, one can appreciate that loop 18 would be forced, instead, in an upward orientation. One way to arrange retainer 10 around member 11 is to place band 16 over an upper or lower lid (13*a*, 13*b*) of an outside wall of member 11 and slide the band 16 either downward or upward, as the case may be, along the outside wall into place. An end 14 of elongated item 19 has been guided into looped portion 18 along taper 23 so that its top-end 15 is oriented a distance "d" from member 11 (this feature is also illustrated in FIG. 1B). Here, grip surface 17 is seen comprised of an upper section 27 of alignment teeth and a lower section 37 of alignment teeth, although only one section may be used (as discussed, suitable other grip surfaces may be employed). Item 19 is leaning against grip surface 17 of band 16. Alignment teeth upper and lower sections 27, 37 have been sized to allow item 19 to fit between adjacent alignment teeth. The series of smaller-sized gripping teeth labeled 24 (or other configuration) press against item 19 by the force exerted from loop 18 against larger member 11. It is critical that retainer 10, with a looped portion 18 protruding from band 16, be of a material/design that provides enough counter-force against member 11 to hold an elongated item 19 within the loop.

Figure 7A:
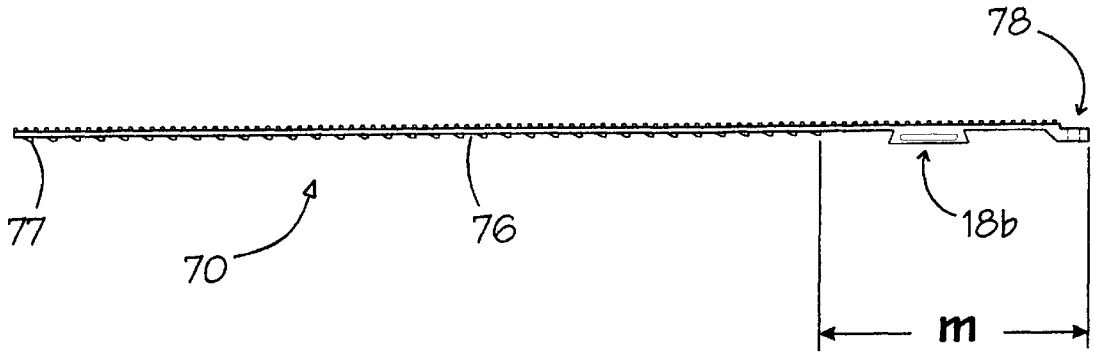
FIGS. 7A and 7B are, respectively, side elevational and top plan views of alternative preferred retainer 70 that has a mechanical catch assembly 77, 78 which has not been employed (shown this way for simplicity).
Figure 7B:
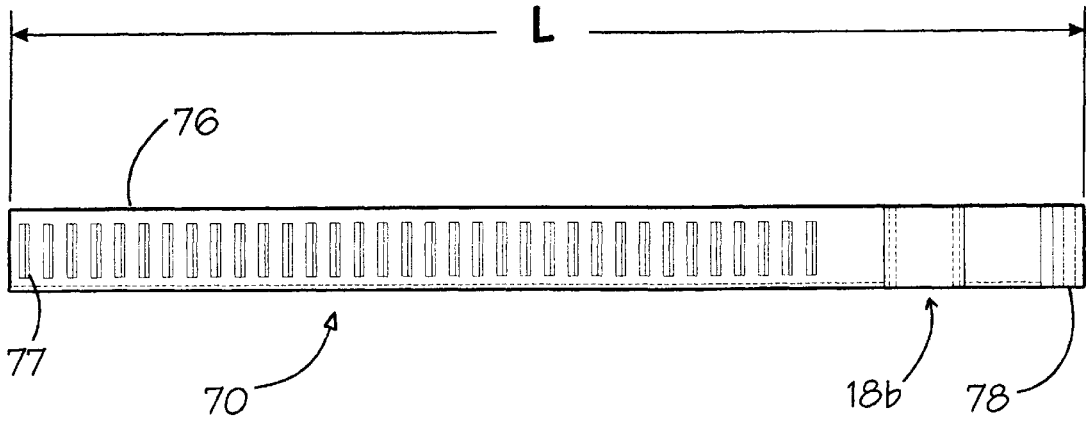

FIGS. 7A and 7B are, respectively, side elevational and top plan views of alternative preferred retainer 70 that has a mechanical catch assembly 77, 78 which has not, yet, been employed (shown this way for simplicity). After wrapping retainer 70 around the periphery of a receptacle member (such as that labeled 11 throughout the Figures) so that looped portion 18*b* is outwardly facing, one can estimate and cut a length "L" of resilient band 76 needed to fit around the periphery. To employ the catch assembly shown, protuberance 77 can be fit into recessed portion 78. This assembly 77, 78 has been illustrated by way of example only, as one can appreciate that alternative mechanical locking configurations can be used to hold the two ends of band 76 together around a receptacle member. By way of example only, if L was 10 inches to fit around a canister, protuberances (such as that at 77) could be molded into band 76 with "m" at 2 inches.

Figure 8:
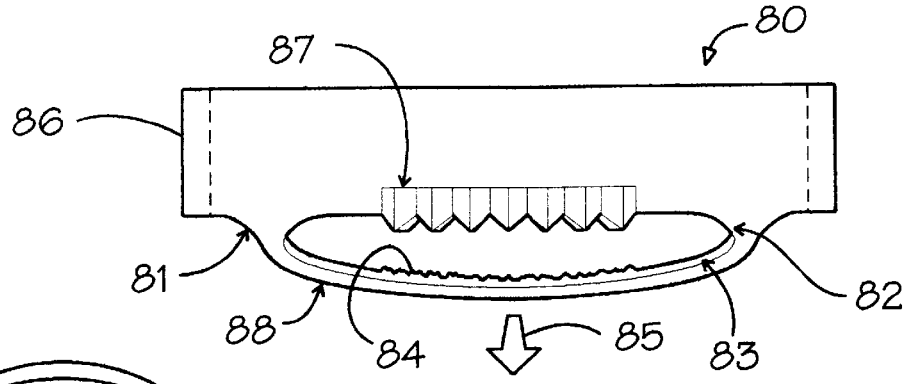
Figure 9:
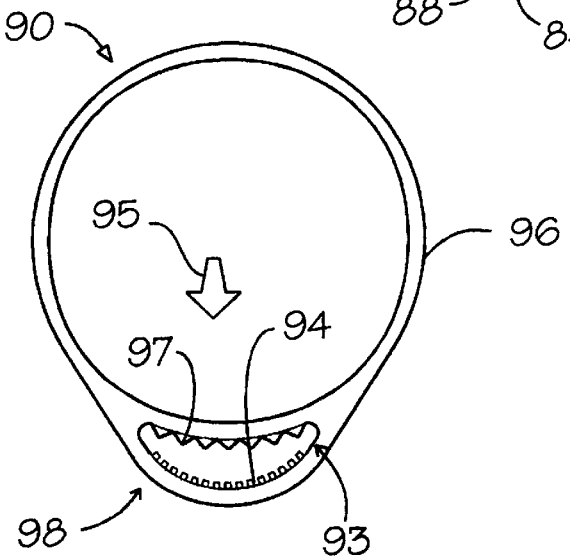
FIGS. 9 and 10A, illustrate alternative retainer embodiments of the invention: Retainer 80 in FIG. 8 has a looped portion 88 initially oriented downwardly (see direction arrow 85); retainer 90 in FIG. 9 has a looped portion 98 initially oriented outwardly from a central area of band 96 (see direction arrow 95); and retainer 100 has two looped portions 108, 109 that are initially oriented toward a central area of band 106 (see direction arrow 125).

The design flexibility of the instant invention is further illustrated in the side view labeled FIG. 8, as well as the top plan views labeled FIGS. 9 and 10A: Each shows alternative retainer embodiments of the invention. Retainer 80 in FIG. 8 has a looped portion 88 initially oriented downwardly (see direction arrow 85) with a taper 83 and textured gripping surface 84 molded therein. Looped portion 88 protrudes from band 86 at end 81, 82. Outwardly-facing grip surface 87 is comprised of "zig-zag" alignment teeth, although many different configurations are contemplated as discussed above. An end of an elongated item can be guided along taper 83 of looped portion 88 and into place so that it can be held to the outside wall of a receptacle member (such that labeled 11 throughout). Well known molding and extruding techniques exist to fabricate and assemble the preferred and alternative embodiments of the retainer.

The alternative retainer 90 in FIG. 9 has a looped portion 98 initially oriented outwardly from a central area of band 96 (see direction arrow 95), with a taper 93 and textured gripping surface 94. Outwardly-facing grip surface 97 is comprised of flat-top alignment teeth. And, retainer 100 illustrated in FIGS. 10A and 10B has two looped portions 108, 109 (although others can be added) that are initially oriented toward a central area of band 106 (see direction arrow 125). The sectional view labeled FIG. 10B (taken along 10B—10B of FIG. 10A) better illustrates the initial orientation of alternative loop 108 with respect to band 106. Similar to loop 18 of FIG. 6, loops 108 and 109 can each have a taper (such as that labeled 103—see FIG. 10B); and band 106 can have an outwardly-facing grip surface 107 comprised of alignment teeth (here, shown as flat teeth).

By way of example only to give a general idea of relative size, a retainer of the invention molded of suitable plastic can have representative approximate dimensions as follows: Height of band 16 can be 0.375 inches; inner diameter "w" of band 16 can be 2 inches (to fit around a larger member approximately 2 to 4 inches in diameter—as the outer diameter of the larger member gets bigger, it becomes more important that the band have greater resiliency); wall thickness of band 16 can be 0.094 inches; total height of loop 18

("h"+"t" in FIG. 4) can be 0.141 inches; and the depth of upper and lower sections 27, 37 of alignment teeth can each be 0.063 inches.

While certain representative embodiments and details have been shown for the purpose of illustrating the invention, those skilled in the art will readily appreciate that various modifications may be made to the invention without departing from the novel teachings or scope of this invention. Accordingly, all such modifications are intended to be included within the scope of this invention as defined in the following claims. In the claims or specification, any means-plus-function clauses used are intended to cover the structures described herein as performing the recited function and not only structural equivalents but also equivalent structures.

What is claimed is:

1. A method of removably holding an elongated item to an outside wall of a larger member comprising the steps of:

arranging a closed-loop resilient band around a periphery of the larger member, said band having a first and second end of a loop protruding from a wall of said band, said loop initially oriented toward a central area of said band;

guiding an end of the elongated item into and through said loop along a taper of said loop;

whereupon said step of arranging a closed-loop resilient band forces said loop downward in orientation; and once said step of guiding an end into and through said loop along said taper has been performed, the elongated item will lean against an outwardly-facing grip surface of said band.

2. The method of claim 1 wherein said grip surface comprises a plurality of outwardly-oriented alignment teeth to aid in aligning the elongated item when said step of guiding an end into and through said loop along said taper has been performed.

3. A method of removably holding an elongated item having a bottom free-end, to an outside wall of a larger member, comprising the steps of:

arranging a closed-loop resilient band around a periphery of the larger member, said band having a looped portion protruding from a wall thereof, said loop initially oriented toward a central area of said band;

whereupon said step of arranging said band forces said loop downward in orientation; and guiding said bottom free-end of the elongated item into and through said looped portion so that once retained therein, a top-end of the item is oriented out and away a distance from the larger member that is greater than any spacing between said bottom free-end and the larger member.

4. The method of claim 3 wherein said looped portion comprises a plurality of gripping teeth at the bottom of a taper; and further comprising the step of gripping the elongated item upon insertion into and through said looped portion with said gripping teeth.

5. A method of removably holding an elongated item to an outside wall of a larger member, comprising the steps of:

arranging a closed-loop band having elasticity around a periphery of the larger member; said band having a first and second end of a loop protruding from in spaced relationship and integrated with said band so as to share a common resilient wall, said loop initially oriented toward a central area of said band;

whereupon said step of arranging said band forces said loop downward in orientation; and guiding, in a generally downward direction, an end of the elongated item into and through said loop so that once retained therein, the item will lean against an outwardly-facing grip surface of said common resilient wall.

6. The method of claim 5 wherein said band and said loop are molded out of a plastic material as a single unit, said grip surface comprises a plurality of outwardly-oriented alignment teeth, and said step of guiding further comprises the step of aligning the elongated item with said alignment teeth.

7. The method of claim 5 wherein said looped portion comprises a plurality of gripping teeth at the bottom of a taper and a reinforcement; and further comprising the step of gripping the elongated item with said gripping teeth once said step of guiding said end into and through said loop along said taper has been performed.

* * * * *